US005782663A

United States Patent [19]

Van Raden

[11] Patent Number: 5,782,663

[45] Date of Patent: Jul. 21, 1998

[54] LINE TENDING MARKER FLOAT

[76] Inventor: Charles Van Raden, 1701 N. 11th St., Moorhead, Minn. 56560

[21] Appl. No.: 805,159

[22] Filed: Feb. 24, 1997

Related U.S. Application Data

[63] Continuation-in-part of Ser. No. 637,130, Apr. 24, 1996, Pat. No. 5,605,481.

[51] Int. Cl.[6] ..... B63B 22/18

[52] U.S. Cl. ..... 441/25; 441/26

[58] Field of Search ..... 441/1, 6, 21, 23, 441/24, 25, 26, 27

[56] References Cited

U.S. PATENT DOCUMENTS

| | | | |
|---|---|---|---|
| 1,993,974 | 3/1935 | McVicker | 441/26 |
| 2,649,019 | 7/1953 | Chetlan | 116/114 |
| 2,903,718 | 9/1959 | Wright, Jr. | 9/9 |
| 2,978,690 | 4/1961 | Kurie et al. | 441/26 |
| 3,002,490 | 10/1961 | Murray | 116/124 |
| 3,441,962 | 5/1969 | Williams | 441/25 |
| 3,461,835 | 8/1969 | Cockbill et al. | 116/124 |
| 3,597,778 | 8/1971 | Castelliz | 441/25 |
| 3,760,440 | 9/1973 | Casciano | 9/8 |
| 4,080,677 | 3/1978 | Koehler | 9/9 |
| 4,103,379 | 8/1978 | Wolfe | 9/8 |
| 4,114,561 | 9/1978 | Asaro | 116/124 |
| 4,475,476 | 10/1984 | Howard | 116/210 |
| 4,586,456 | 5/1986 | Forward | 116/210 |
| 5,231,952 | 8/1993 | Tenniswood | 116/210 |

*Primary Examiner*—Stephen Avila

*Attorney, Agent, or Firm*—Westman, Champlin & Kelly, P.A.

[57] ABSTRACT

A line tending device includes a clutch hub that controls the paying out or extension of a line when the line is under tension. The clutch hub includes an O-ring around a hub outer surface and under which the line extends. The O-ring permits the line to extend in direction substantially parallel to the axis of the hub that supports the O-ring, but the O-ring exerts a load on the line to tighten and effectively clamp the line against an edge of a flange on the clutch to prevent the line from extending when the angle of the line relative to a hub axis exceeds a preselected amount. The line tending device, is adapted for providing floating markers in a body of water.

16 Claims, 10 Drawing Sheets

LINE TENDING MARKER FLOAT

CROSS REFERENCE TO RELATED APPLICATION

This application is a continuation-in-part of my application Ser. No. 08/637,130, filed Apr. 24, 1996 for Line Tending Marker Float, now U.S. Pat. 5,605,481.

BACKGROUND OF THE INVENTION

The present invention relates to a marker float that has an anchor weight attached to an anchor line coiled onto a reel and having a line clutch that permits the anchor line to be paid out or unwound as long as the line extends substantially directly below the float device, but which stops the anchor line from unwinding when the float drifts sideways, so the angle of the anchor line changes from vertical.

In the past, various marker floats have been utilized for a wide variety of purposes including marking fishing spots, which is a prime objective, as well as providing a marker or buoy for indicating that a diver is below the surface. A problem exists where the marker anchor has a fixed length anchor line or a reel that will permit the anchor line to be extended, because the action of waves and wind will tend to move the marker float to a location that is other than directly above the anchor, which means the desired spot is no longer marked accurately.

These marker buoys may nave floats that are fixed volume, or the markers can be compact units that have an inflatable balloon like device that will extend from the water surface and will float up, for example, when a diver is marking a spot from near the bottom of the body of water.

Various devices have been advanced in an attempt to overcome the drift problem of a floating marker. For example, in U.S. Pat. No. 4,103,379 a marker buoy is shown with an inflatable body, and a central core that forms a reel for a line attached to an anchor weight. The unit includes flexible finger elements that allow the anchor line to unwind off the hub while an anchor weight drops to the bottom. It is stated that the flexible fingers will prevent further unwinding of the anchor line, but this is only effective after the line is manually clipped in place. If manually clipped the anchor line will not extend from wave or wind action.

U.S. Pat. No. 3,760,440 shows a diver signal and/or marker that includes a flexible inflatable bag that will rise to the surface when desired to mark the position of a diver.

U.S. Pat. No. 5,231,952 also shows a stowable, inflatable marker for marking underwater locations, utilizing a weight and an anchor line.

Other similar devices are known, but none include a compact line clutch that is sensitive to the angle of a line relative to a float, to automatically prevent unwanted extension of the line. The line clutch of the present invention can be used with an inflatable marker as shown, or with a float such as a plastic bottle that can be attached to the end of the clutch and line reel mechanism for operation. It also can be used for diver's flags and similar applications.

SUMMARY OF THE INVENTION

The present invention relates to a line tending clutch that controls the amount of line that unreels, from a reel under loads, when the end portion of the line being extended forms a substantial angle relative to the axis of the clutch. As shown, the line is used for tending floats in water. A floating member, such as a marker buoy remains directly above the marked location. The marker may be a diver's flag, which reacts or provides the force on a line relative to a diver below. The flag will stay substantially directly above the diver.

The line tending clutch of the present invention may be utilized with any type of float or other tension load applying members where extending the line is to be controlled and restricted when the angle of the line relative to an axis of the clutch increases more than desired. In one form of the invention, the float is self storing inside a housing for the line tending apparatus, or the clutch and line reel can be a coupled to a preformed float, such as a plastic bottle, merely by screwing the line reel, clutch, and anchor weight assembly onto the bottle.

A diver's flag may be held by the line while the line and clutch housing is connected to a diver. The diver's location below the surface is marked, or the unit can be used for marking a location for a hot fishing spot.

An anchor weight may mount onto a main housing so that the unit is very compact when the inflatable bag disclosed is stored. When used by a diver, the diver attaches the line and clutch housing to a belt so the housing moves with the diver.

The line passes from the reel housing to a line feed clutch region which comprises a center clutch hub or drum having end flanges that extend outwardly from the hub a selected amount. The line is placed underneath an elastomeric ring, commonly called an "O" ring, which surrounds the hub, and which can move up and down on the clutch hub between the flanges. When the line is being removed from the reel and extending substantially straight axially from the float, the line will uncoil from the reel as the line moves around the surface of the clutch hub under the O-ring, because the selected tension of the O-ring is not sufficient to clamp the line. The O-ring can easily stretch and assumes a position where it does not act to "snub" the line against one end flange of the clutch hub.

However, when the float starts to drift off the vertical alignment or when a diver moves from the original spot, the line forms an angle from the axis of the float. When the angle is in the range of 15° or so, the line will force the clutch O-ring to move toward one flange on the clutch hub and the angle of the line as it bends around the one flange causes the O-ring to act to "snub" the line and prevent it from coming off the reel.

In other words, the angle of the line will cause the O-ring to move toward the flange of the clutch, adjacent the end of the reel toward which the line is being fed, until the O-ring exerts enough force and moves adjacent a flange to clamp or snub the line and prevent further pay out under normal loading.

The floats are subject to wind and wave loading. The action will effectively maintain the length of line between the member connected to the length of line being payed out and the clutch to cause the line to extend substantially directly axially and remain directly above the weight at all times. Any action tending to move the float along the water surface, such as wind or waves, will merely cause the float to bob around as it is held in its desired position. Also lateral movement of a subsurface object will cause the marker float to move on the water surface to follow the subsurface object.

DETAILED DESCRIPTION OF THE PREFERRED EMBODIMENTS

Figure 1:
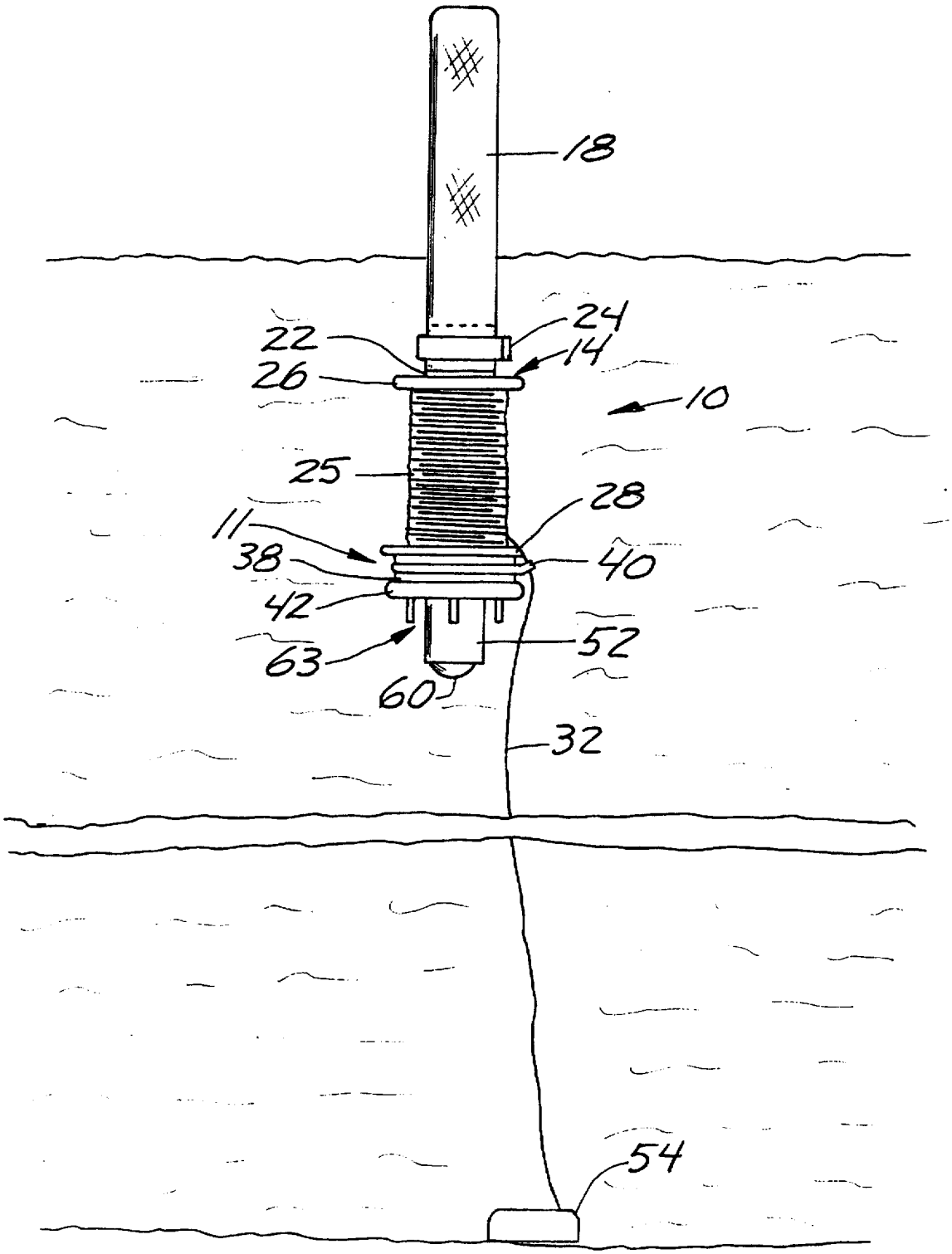
FIG. 1 is a schematic representation of a line tending marker float made according to the present invention utilizing an inflatable float.
Figure 2:
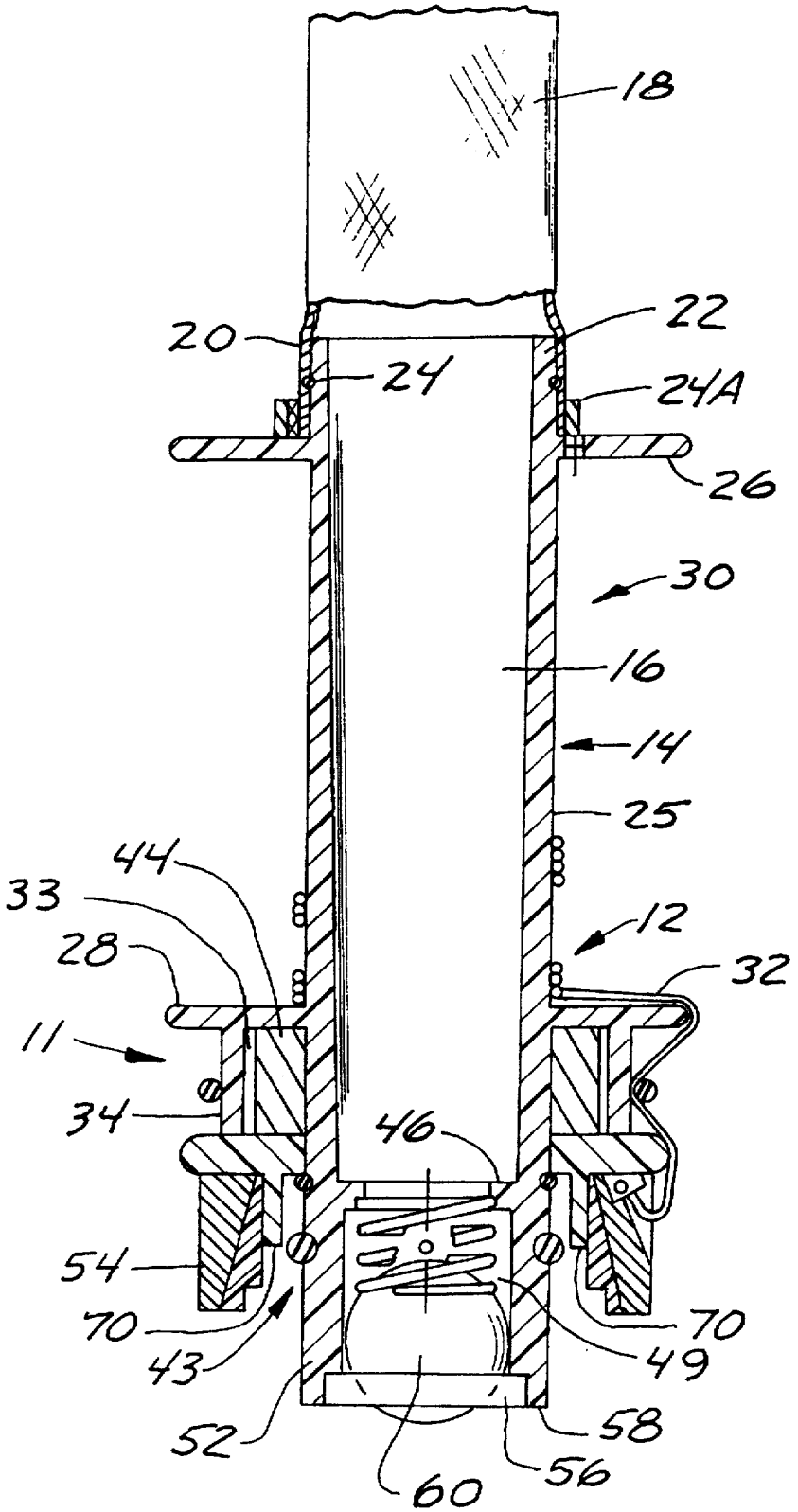
FIG. 2 is a sectional view of the float of FIG. 1 including a line clutch assembly.
Figure 4:
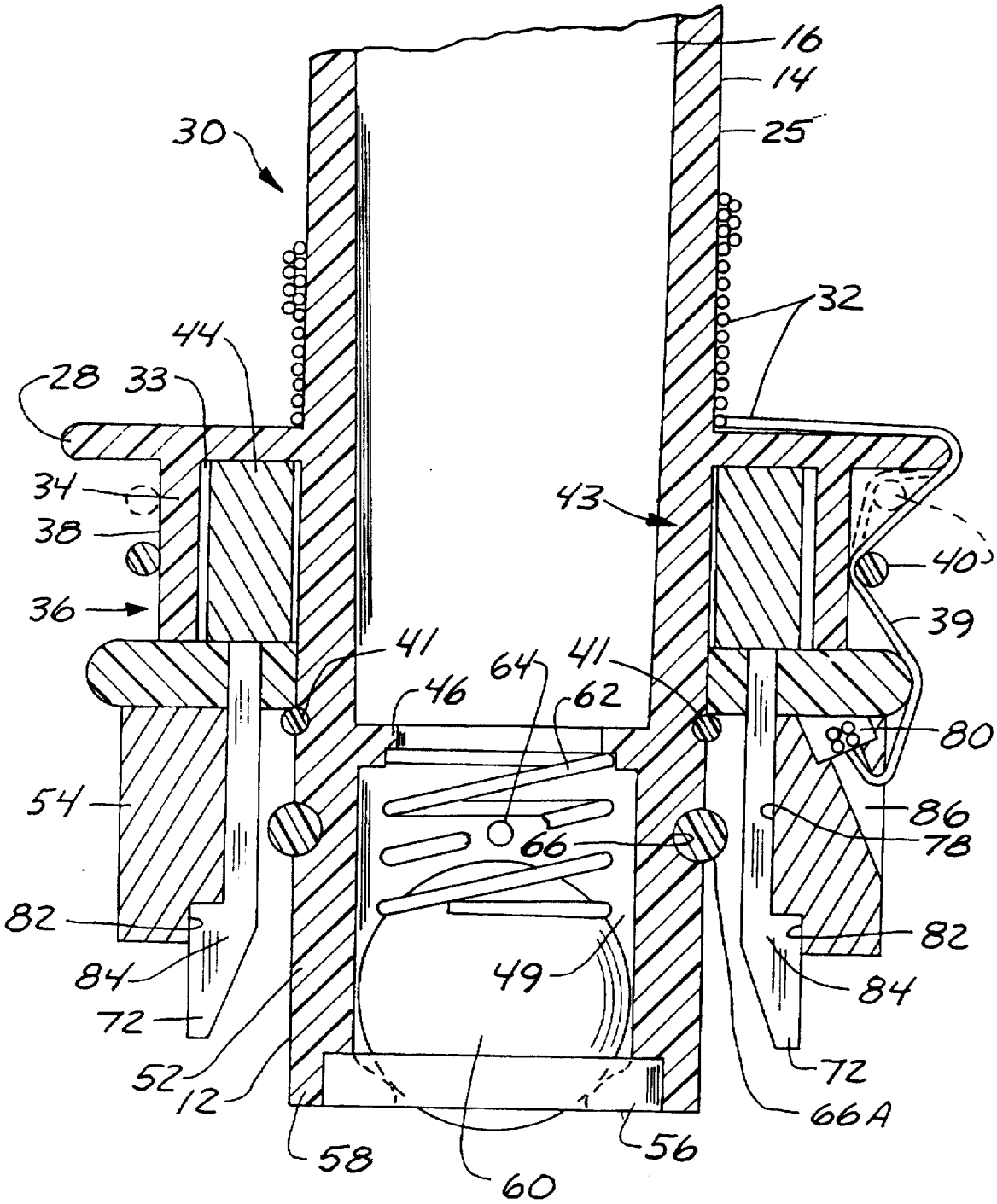
FIG. 4 is a sectional view taken as on line 4—4 in FIG. 3.
Figure 5:
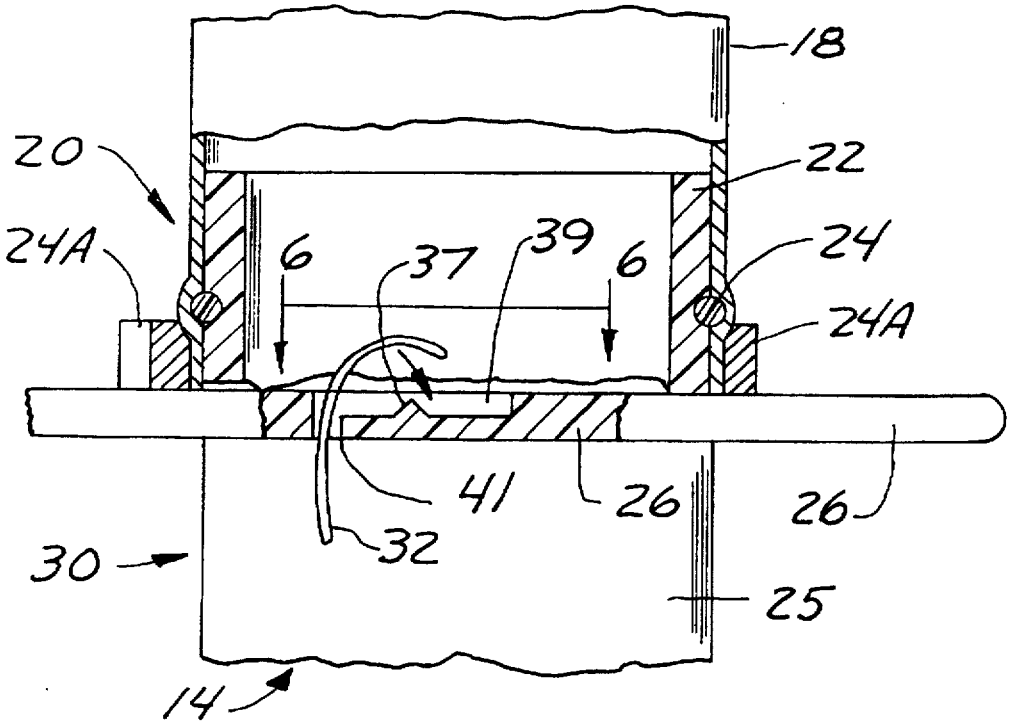
FIG. 5 is a fragmentary enlarged view of the float end of the marker of FIG. 2, with parts broken away.

Referring to FIG. 1, a marker float indicated generally at 10 includes an anchor line tending device 11 made according to the present invention. As shown in FIGS. 1, 2 and 4 the line tending device 11 comprises a support housing or frame 12 that has a cylindrical tubular section 14 having an interior passageway 16. An airtight, inflatable float bag 18 has its open end 20 mounted over a neck 22 of the cylindrical portion 14. The interior of bag 18 is sealed air tight relative to the outer surface of the neck 22 as shown in FIG. 5 through the use of an O-ring 24 which surrounds the neck 22. The end 20 of the bag 18 is slipped over the O-ring 24 and a suitable, well-known band clamp 24A is clamped around the bag end 20 to hold it onto the neck 22. This makes the interior of the float bag, which can be a rubberized fabric or other suitable material, open to the passageway 16 on the interior of the cylindrical portion 14.

The housing 12 has a line reel section 30 formed with a hub portion 25 positioned between two annular flanges 26 and 28 that are spaced along the cylindrical member 14 to form the line reel section 30 on which a suitable anchor line or cord 32 can be wrapped. The cord 32 is wound around the hub portion 25 in a normal manner, and an attempt is made to have it "level wound" so that it will not snarl as it is unfurled or unwrapped.

The cylindrical portion 14 includes an annular wall 34 near the lower end (FIG. 4) that is below and integral with flange 28. Wall 34*a* is spaced from the wall of cylindrical section 14 to form an annular space 33. The wall 34 also forms an anchor line clutch hub 36. The clutch hub 36 has a clutch hub surface 38 that is positioned between the underside of reel flange 28, and a second clutch flange 42, that has a center opening to permit it to be slid over the outer surface of the base end 43 of housing 12. The flange 42 is held against the end of wall 34 with a retainer ring 41. The flange 42 is thus securely held in place. The retainer ring 41 could be a metal snap ring, or an O-ring. The flange 42 is smaller in diameter than flange 28 and rounded more so the line 32 slides over and along the edge of flange 42 easily unless the clutch operates to snub the line, as will be explained. The line 32 travels around the edge of both clutch flanges 28 and 42 as it unreels or pays out. The line passes under an O-ring 40 that fits over the clutch hub surface 38 and is of strength to provide a drag on the line 32 and provide the clutch action.

Figure 6:
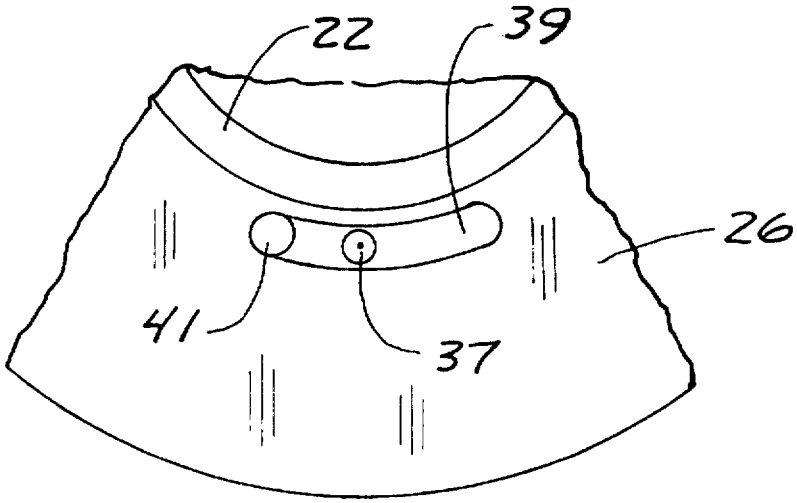
FIG. 6 is a fragmentary plan view taken on line 6—6 in FIG. 5.

As shown in FIGS. 5 and 6, one end of line 32 can be held on the line real using a retaining pin or prong 37 in a recess 39 formed on the top of flange 26. The line 32 is passed up through a hole 41 in flange 26 from the line reel and, then pushed onto prong 37 to retain it in place. Other line securing devices can be used.

The annular space 33 between wall 34 and the outer surface of the lower portion 43 of cylindrical portion 14 of the housing 12 contains a ring, like lead ballast or counterweight 44. The counterweight 44 is put into the opening 33 before the flange 42 is assembled onto housing 12. The counterweight 44 is held in place when the flange 42 is mounted and held with retaining ring 41.

The lower portion 43 has an internal ring type wall 46 dividing the cylindrical portion 14 from a lower check valve neck 52. In storage position the neck 52 is surrounded by a ring like anchor weight 54. The lower end of the interior bore 49 of neck 52 has a suitable seal 56, such as a shaft oil seal, to provide a seat for a check valve ball 60. The seal 56 is held in a recess on the interior of the bore portion 49. Check valve ball 60 is mounted in the bore 49 and is urged toward the seal 56 with a spring 62 that is supported on wall 46 and exerts a spring load tending to seat ball 60 on seal 56.

The neck 52 is also provided with a pressure relief valve arrangement for the bore portion 49 and the passage 16. The pressure relief valve arrangement includes one or more pressure relief bores 64 in the wall of neck 52 through the bottom of an exterior O-ring groove 66 seating an O-ring 66A. Ports 64 open to the bore 49. There are preferably three bores 64, and two are shown in FIG. 4. The O-ring 66A serves as a relief valve, so that if the pressure in the bore 16 or 49 becomes excessive, the elastic O-ring 66A will move outwardly slightly from the bottom surface of the groove 66 and will then permit air under pressure inside the bore 49 to be relieved outwardly. This over pressure relief valve acts so that if the air pressure in the inflatable bag 18 becomes excessive, pressure will be relieved even though the bail 60 remains seated on the seal 56.

Figure 3:
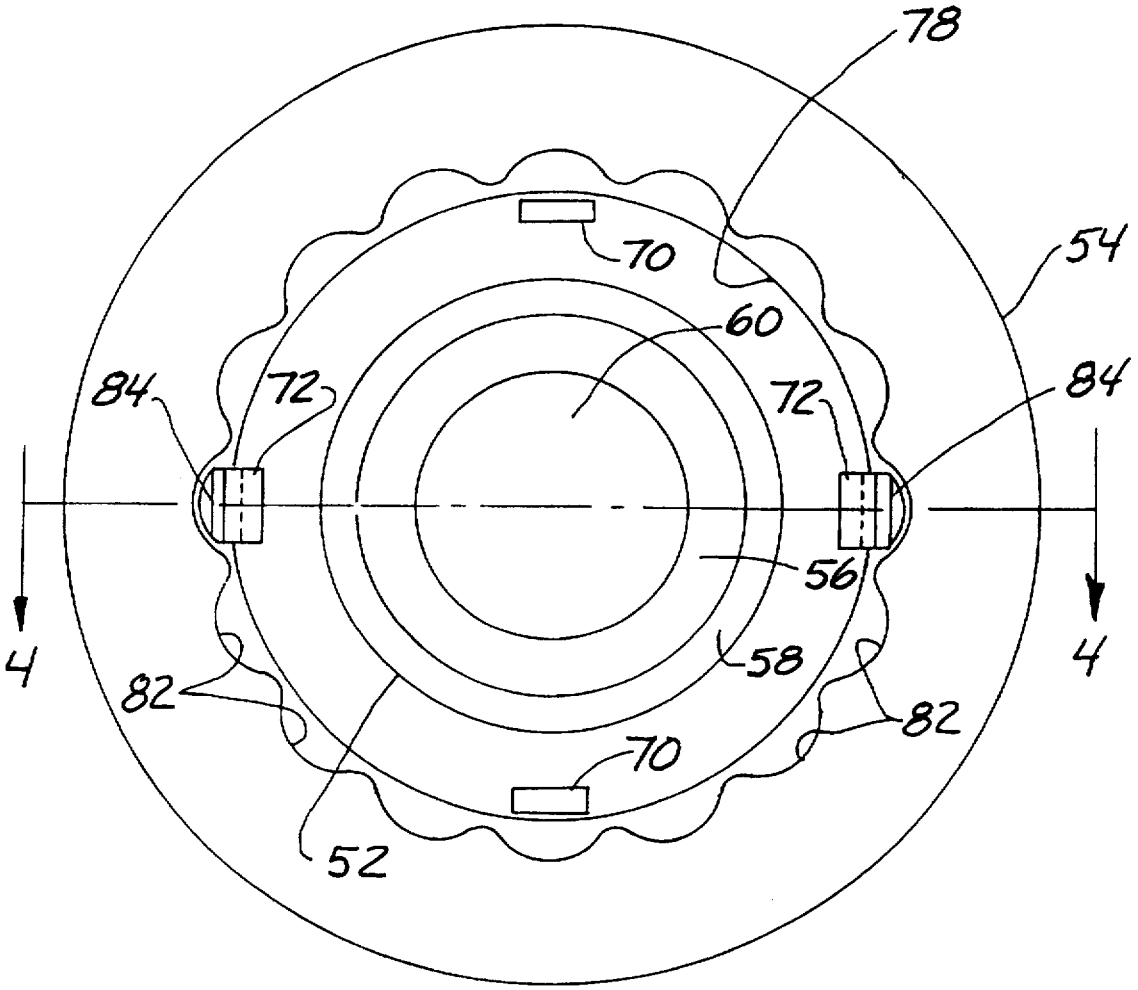
FIG. 3 is a sectional view of a typical weight and line windup mechanism utilized with the present invention.

The flange 42 has, as can be seen in FIGS. 2 and 3, a pair of downwardly depending guide members 70 on opposite sides of the neck 52, and as shown in FIGS. 3 and 4, a pair of spring loaded latch detents or latch fingers 72 on opposite sides of the neck 52, which are offset 90° from the guide members 70. The guide members 70 and spring latch fingers 72 can be made of selected plastic material and epoxied or otherwise secured in place on flange 42. The guides and fingers guide the ring like anchor weight 54. The anchor weight 54 can be a block of lead that has a central bore 78 of size to fit around the guide fingers 70 and the detent fingers 72.

The lower end of the bore 78 has a series of inwardly facing detent notches 82 around the periphery, and the notches 82 receive lugs 84 formed at the end of the spring detent fingers 72. When the lugs 84 are within aligned notches 82, the anchor weight 54 is held against the underside of the flange 42 and is also restrained from rotation on the guides 70 and shank portions of the spring detent fingers 72 relative to the flanges. However, because the spring detent fingers 72 are made "springy", manual rotation of the anchor weight will cause the fingers 72 to "click" into the recesses 82 as the weight rotates. This permits rotating the anchor weight 54 on the guide members 70 and spring detent fingers 72 for tightening the anchor line 32 around the reel hub 25 as will be explained.

As shown in FIG. 4, the anchor weight 54 has an angled bore 86 through the sidewall and opening to the upper surface of the anchor weight. The anchor line 32 passes through this bore 86 and can be knotted in an enlarged countersunk portion 80 so that it will be retained in the enlarged countersunk portion 80 of the bore 86. The anchor line 32 is thus securely held on the counter weight. The line 32 will be wound on the line reel hub 25 as previously mentioned. The cord 32 can be any desired length as needed. As shown in the assembly of FIG. 2 the anchor weight 54 will be secured on the flange 42 and held by the guide members 70 and spring detent or latch fingers 72.

The anchor weight 54 can be removed from the housing 12 by grasping the outer ends of the spring detent fingers 72 and moving them inwardly so that they clear the inner bore 78 of the anchor weight. Then the anchor weight 54 can be removed. This will permit the anchor line 32 to be dragged downwardly as it unwinds or unwraps and moves around the edge of the flange 28 around the clutch hub 36. The line will unwind from the cord reel hub section 25 as the line moves around the edge of the flange 28 and moves around surface 38 under O-ring 40, until the anchor weight 54 strikes the bottom of the body of water, assuming that the float device has been inflated or is separately attached, if preinflated.

The line 32 can be retrieved and wound manually onto the line reel 25, until there is only a short length of cord left free, sufficient to permit the anchor weight 54 to be fitted over the outer end of the neck 52 and slid into place on the spring detent fingers 72 and the guides 70. The anchor weight is held on the under the surface of the flange 42. Then the anchor weight can be rotated about a central axis as guided by the guides 70 and spring fingers 72, as the ends 84 of the spring fingers 72 click in and out the detent recesses 82. The anchor weight 54 will be rotated in the proper direction to further tighten the line 32 on the reel, until the line 32 is held securely and tightly on the reel, with no slack. The spring detent fingers 72 will hold the anchor weight 54 in this rotational position with the line 32 taut and properly secured.

In a "stored" and deflated position, the inflatable float bag 18 will be deflated and stuffed inside the bore 16, but will be held sealed at its open end by the clamps 24A on the neck 22. The user then will have a very compact float and marker assembly that can be retrieved from its storage location, such as on a diver's belt, or a tackle box if used by the people that are fishing, and the bag 18 can be inflated by merely placing the neck 52 gently against your lips to unseat the ball 60 and blowing causing air to inflate the float bag 18. The bag 18 will be pushed out of the bore 16 into its erected position as shown in FIG. 1. Oral inflation will provide the desired amount of pressure as regulated by the operator and the relief valve O-ring 66A. The anchor weight 54 can then be removed from the housing 12 by manually inwardly retracting the outer ends of the spring fingers 72, and pulling the anchor weight off the spring fingers 72 and the guides 70.

Once clear of the spring fingers 72, the anchor weight 54 and the floatation device, with the float bag 18 inflated, can be thrown overboard or released by a diver. The float bag 18 will act as a float for the housing 12 with the bag 18 upright as shown in FIG. 1. The anchor weight will pull on the cord 32 to unwind it from the cord reel hub as the anchor weight drops straight downwardly from the float as shown in FIG. 1. Once the anchor weight 54 hits the bottom of the body of water, the floating housing will be anchored in place and the O-ring clutch will act to keep excess line 32 from paying out or unreeling from the line real hub. As soon as the float drifts off from a substantial vertical position only a few degrees, the O-ring 40 will stretch and expand due to increased load on the line 32. The Oaring 40 also will roll toward flange 28 tending to cause the line to be snubbed against the edge of the flange 28 as illustrated in FIG. 2. The O-ring 40 is selected to provide increasing load as it expands, as most elastomeric materials do, and this, coupled with the fact that the O-ring moves upward toward the flange 28, will cause the holding action for the line 32 to prevent the line from unwinding more. The snubbing of the line 32 will maintain the line length substantially constant so the float bag and float housing 12, stay substantially vertically over the desired marked area.

Figure 7:
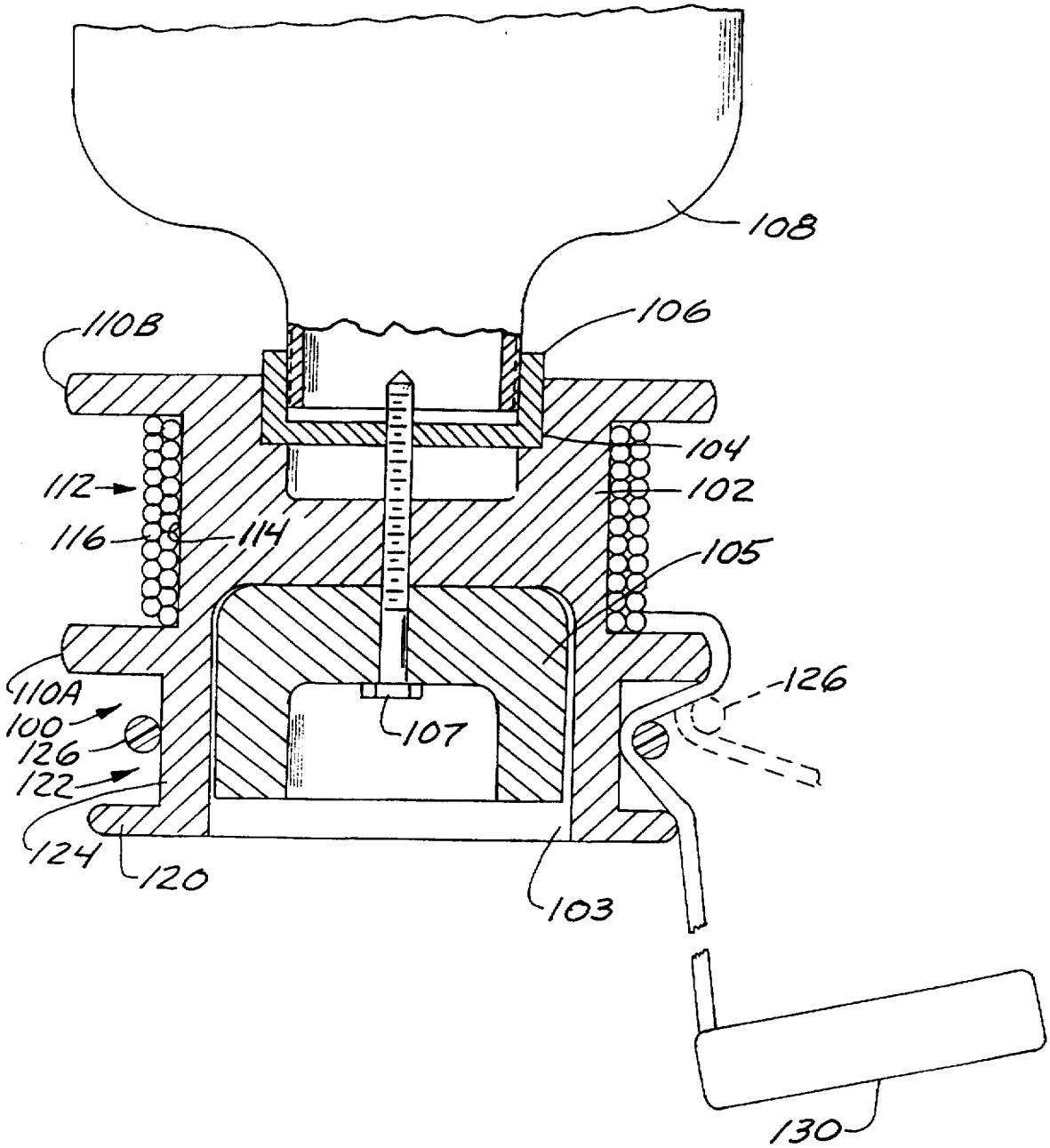
FIG. 7 is a sectional view of a modified form of the line tender of the present invention illustrated in place on a permanent float comprising a plastic jug threaded into place.

A modified form of the invention is shown fragmentarily in FIG. 7 in cross section, and illustrates the use of a fixed float utilizing an anchor line clutch hub assembly substantially identical to that shown at 36 in the previous form of the invention. In this form of the invention, an anchor line clutch hub assembly indicated generally at 100 has a hub body 102, with a recess 104 at the upper end. A plastic jug 108 has threads 106 that thread as at 107 into internal threads formed in this recess. The threads can be made in different sizes to fit different jugs.

The body 102 has a large recess 103 on the lower side, which receives a ballast or counter weight 105 of suitable size, which is secured in place as desired.

An empty plastic jug or bottle 108, such as a water bottle or other screw cap bottle, is inverted and pushed or screwed in place with the threads 106. As shown the jug 108 forms a float that is of a fixed size and does not need inflation.

The hub 102 has a pair of spaced apart flanges 110A and 110B that form a cord reel 112, having a reel hub surface 114 on which an anchor line 116 is wound.

As schematically shown, a flange 120 is used for part of a line clutch 122. The clutch assembly 122 has a hub surface 124 that is surrounded by an O-ring 126, which is positioned between the lower line reel flange 110A and the flange 120. The anchor line 116 is passed under the O-ring 126, as in the previous form of the invention, and is secured to a lead anchor weight 130. This lead anchor weight 130 can be formed as a narrow elongated band, and since lead is malleable, it can be wrapped around the clutch hub, or wrapped around the line reel after the line is manually reeled into place, to hold the line securely in place. The length of the strap weight 130 is selected so that it will lock around the cylindrical hub in a suitable location. The weight 130 is sufficiently heavy so that it will cause the cord to be unreeled by unwinding around hub 110A and moving under the O-ring 126 so long as the cord is extending substantially vertically downwardly. Once the weight 130 hits the bottom of the body of the water, it will anchor the float jug 108 and the hub.

If the anchor line 116 goes off at an angle, as illustrated in dotted lines in FIG. 6, the O-ring 126 will extend, and roll toward flange 110A and will cause a "snubbing" action on the outer edge of the lower flange 110A to secure the anchor line 116 from further extension. In this way it is insured that the float will not be moved by winds or waves to a position other than a few degrees from a position vertically above the weight 130.

The weight 130 can be held in place on the line reel in the same manner as shown in the first form of the invention, if desired, but for convenience in making the size small and easily stored in a tackle box, using a strap weight that merely wraps around the line reel when the line 116 has been tightly wound is satisfactory.

Of course, other types of clamps for holding the line can be used as well, once the line has been fully rewound. The size (both the diameter of the ring and diameter of the cross section of rubber) the O-ring 126 may be varied, as well as the diameter of the O-ring, depending on the size and stiffness of the line 32 or 116 and other factors, such as the size of the flange over which the line extends before it passes under the O-ring. The size of the float, which determines the lateral forces tending to move the float on the surface from a vertical position also is a factor in the O-ring size.

In one example, utilizing a 3/32 inch diameter polypropylene line, and a clutch hub that had an outer diameter of 2.5 inches together with a flange against which the line was snubbed that had an outer diameter of 3.25 inches and a number 141 O-ring of 50 durometer, made by Precision Associates was used. This arrangement provided good results for maintaining a small diameter (2 inches or so) float above the weight, when the float was an inflatable bag type float as shown in the first form of the invention. The size of the line has the most influence on the O-ring needed for a clutch.

Figure 8:
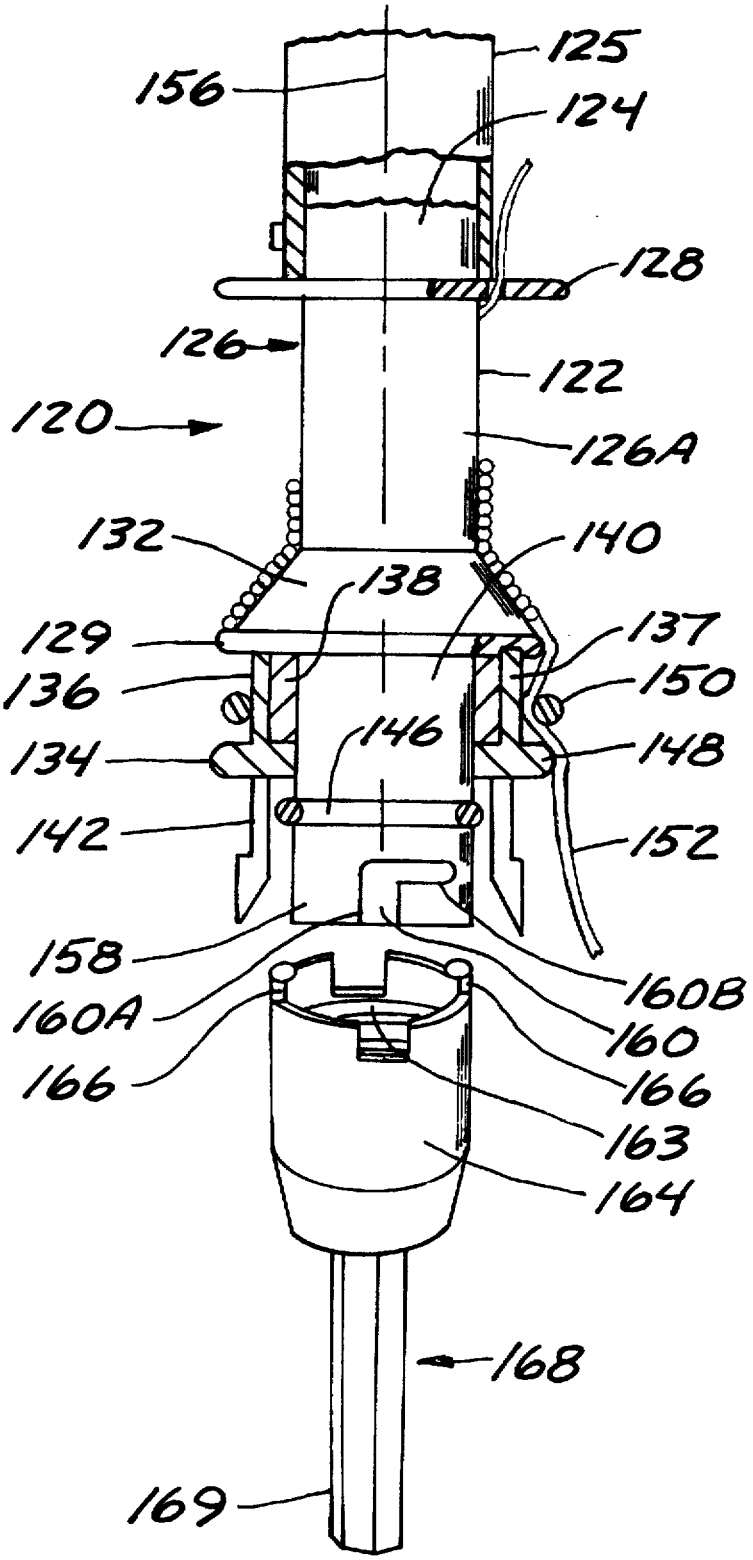
FIG. 8 is a part sectional exploded view of a further preferred embodiment of the line tender of the present invention and illustrating a light that can be removably attached to the line tender.
Figure 9:
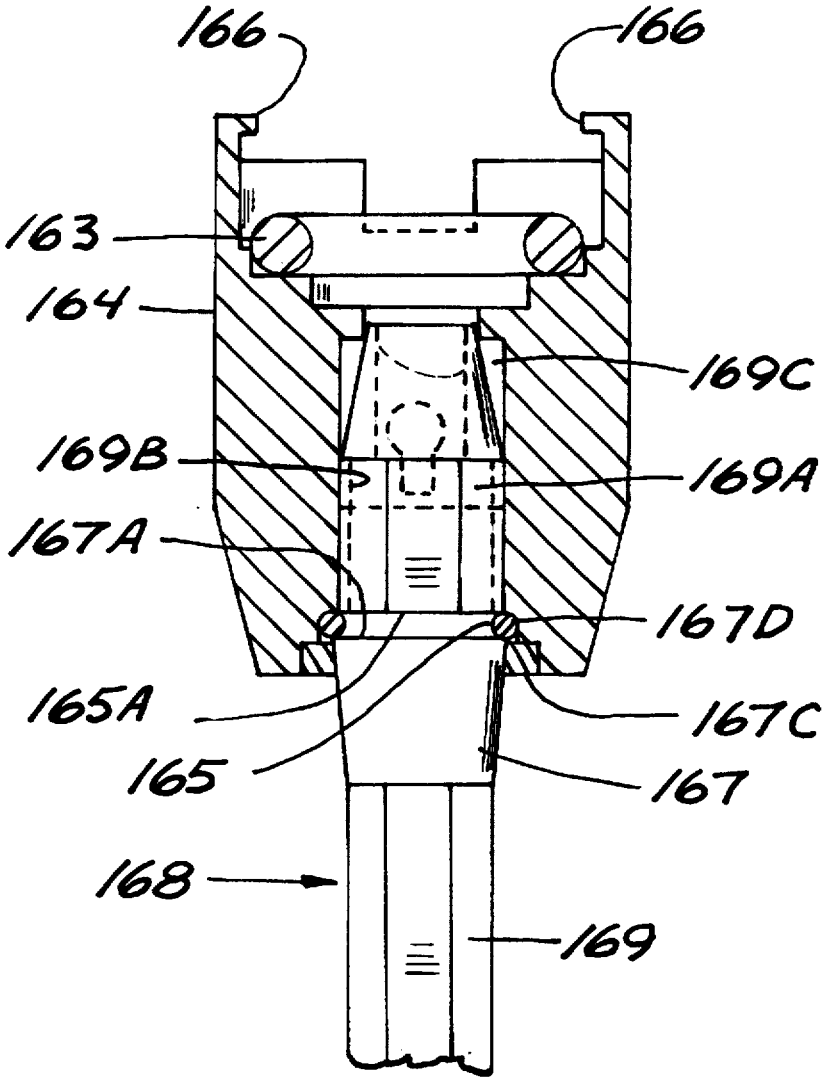
FIG. 9 is an enlarged fragmentary sectional view of the light adapter shown in FIG. 8.

A further modified preferred embodiment of the present invention is shown in FIGS. 8 and 9. The embodiment shown in FIGS. 8 and 9 can be incorporated into the apparatus shown in FIG. 1, as well as that shown in FIG. 7. In this form of the invention, a line tending device indicated at 120 includes a support housing or base 122 that includes a cylindrical tubular section 124. The inflatable bag 125 is put onto the top end of the device shown in FIG. 8, and a suitable check valve for inflating the bag is provided at the lower end as disclosed in the first form of the invention.

The line reel section of the housing 122 is indicated at 126 and includes a first or upper annular flange 128 and a second or lower flange 129. The flanges 128 and 129 are spaced apart along the cylindrical line reel section 126, as shown in the first form of the invention. The line reel section 126 in this form of the invention has a part conical surface 132 that tapers from the cylindrical surface portion 126A to adjacent the outer edge of the flange 129. This aids in insuring a smooth unreeling of the line.

An anchor weight retaining assembly 134 is below flange 129 and includes an annular wall 136 that abuts against the second or lower flange 129. The assembly 134 is held in place with a retaining ring or in another selected manner. A counter weight 138 is positioned between the annular wall 136 and the outer wall of valve section 140, where the ball type inflation valve shown in the first form of the invention is mounted. The anchor weight retaining assembly 134 includes resilient fingers 142 that correspond to the fingers 72 in the first form of the invention for holding a counterweight, such as counterweight 54, in position.

The O-ring 146 corresponds to the O-ring 66A in the first form of the invention to form a valve for overpressure protection.

In this form of the invention, the outer surface 137 of wall 136 forms a clutch hub surface, between the flange 129 and a flange 148 that is part of the counterweight retaining assembly. A resilient elastomeric ring or O-ring 150 surrounds the clutch hub surface 137, and urges the free or extendable end length of a line 152 toward the clutch hub surface 137 as previously explained. The opposite end of line 152 is wrapped around the cylindrical surface 126 of the line reel hub, and also wraps around the tapered, part conical surface 132 so that it feeds off the outer edge of the flange 129 relatively easily. The line 152 also can be passed upwardly from the flange 128 and used for attaching other members, such as markers, to the assembly.

The line clutch works as previously explained, and when the line 152 is extended because of a weight or force that places a tension in the line 152 and tends to move the line off the reel hub 126 and under the O-ring 150, the line will continue to be payed out until the weight or force stops pulling on the line, or until the angle of the line increases relative to the central axis shown at 156 of the reel hub 126 and clutch hub surface 137 to a point where the O-ring moves upwardly toward the flange 129 and creates a "snubbing" action as previously explained.

The lower cylindrical portion 158 of the housing or base 122 is provided with a twist lock groove 160 that has a main portion 160A and a lock portion 160B that is made for supporting a hub or adapter 364 through the use of twist lock fingers 166 that are positioned 180° apart on the hub or adapter 164. In FIG. 8, the twist lock fingers are rotated 90° from the position where they would be inserted into the twist lock grooves 160, for illustrative purposes.

The adapter 164 is made to mount a suitable, standard small flashlight 168 that can be of any desired design. The light battery case 169 extends downwardly from the body 122 and a bulb (shown in dotted lines in FIG. 9) mounted on the battery case and in the interior of the adapter, projects a light beam upwardly through the tubular body 124. This illuminates the float 125 from the interior and provides a visual indication of the position of the float at night. This can be used for fishing spot identification or other purpose. The check valve ball is transparent or clear when the light is used. The battery operated light 168 is adapted for support with the adapter hub 164 so it can be twist locked onto the line tending housing, and by threading the case relative to the bezel, retained in place with an O-ring in the adapter.

Suitable seals can be provided to seal the adapter as needed for operation. It also should be mentioned that the check valve used for inflating the inflatable bag can be provided with known seals and other structure for insuring a good seal of the ball on its seat.

In FIG. 9, the adapter 164 shown in cross section to show the mounting of the light 168. The light 168 is a flashlight that includes the case 169 and a bezel 169A that threads onto an upper end of the case 169 as shown in dotted lines at 169B. This is a conventional arrangement whereby the turning on and off of the light is by twisting the bezel 169A relative to the battery case 169 to cause the bulb that is shown in dotted lines to be illuminated.

The bezel 196A has a hex shaped cross section portion, and the interior receptacle for receiving the bezel which is indicated at 169C is also hex shaped, so that when the hex shape of the bezel is in the hex shaped receptacle the battery case 169 can be rotated (threaded) relative to the bezel for turning the light on and off. In this form of the invention, the neck portion shown at 167 of the battery case 169 has a shoulder 167A that bears against an O-ring 165 positioned between the shoulder 167A and the end surface 165A of the bezel. When the bezel 169A is loosened to a point where the light is out and the O-ring 165 is not compressed it is of size so that the O-ring 165 will slip past a retaining ring 167C that is fixed in a groove provided in the adapter 164. When the light is inserted in its proper position and the bezel is tightened down (threaded) onto the battery case 169, the O-ring 165 will be squeezed and expand so that it expands to a groove into a groove indicated at 167D that is formed between the ring 167C and a shoulder in the adapter 164.

The bezel is tightened until the light is on. The light 168 is then locked in place in the adapter 164.

When the light is to be turned off the battery case 169 can be twisted so that the bulb goes off, and if the light is to be removed for any reason, and separated from the adapter 164, the battery case is merely loosened sufficiently so that the O-ring 165 contracts and clears the interior diameter of the retainer ring 167C. The light can then be pulled out past retainer ring 167C.

Also shown in FIG. 9 is the use of a relatively stiff O-ring 163 which provides a spring action when the lock tabs 166 are placed into the twist lock grooves 160. The end surface of the line tending body will engage the O-ring 163 and the O-ring 163 will compress, causing a spring force to hold the adapter in place on the twist lock grooves.

As can be seen, the adapter 164 is recessed out to provide adequate clearance for the ball check valve, and other operating components on the housing.

Again, the bore 169C is hex shaped in cross section, to receive a hex shaped cross section portion of the bezel 169A so the battery case 169 can be twisted relative to the bezel and the light 168 turned on and off.

Figure 10:
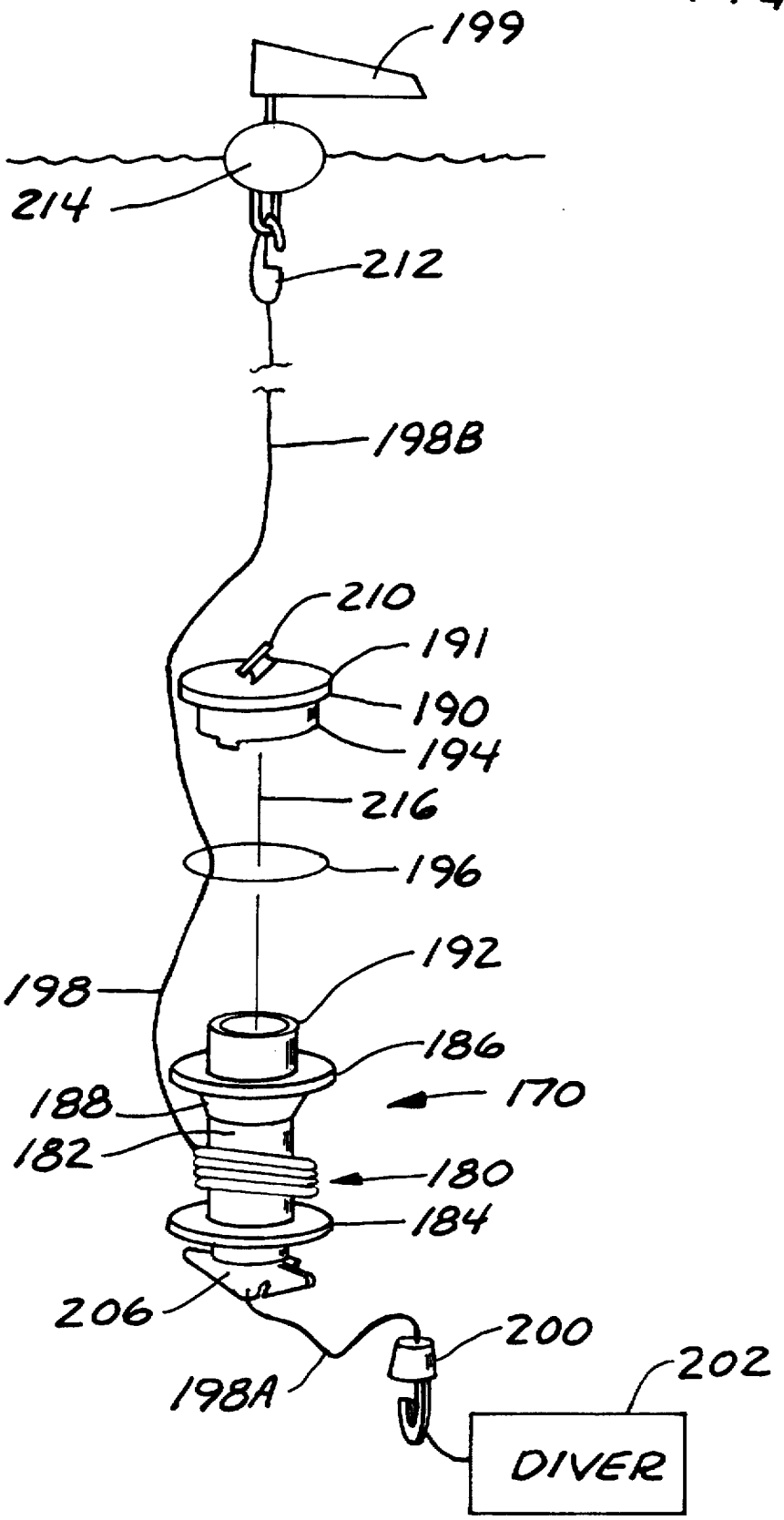
FIG. 10 is an exploded view of a modified form of the invention utilized with a diver's flag, where the diver is below the surface floating and the line reel and clutch move with the diver.
Figure 11:
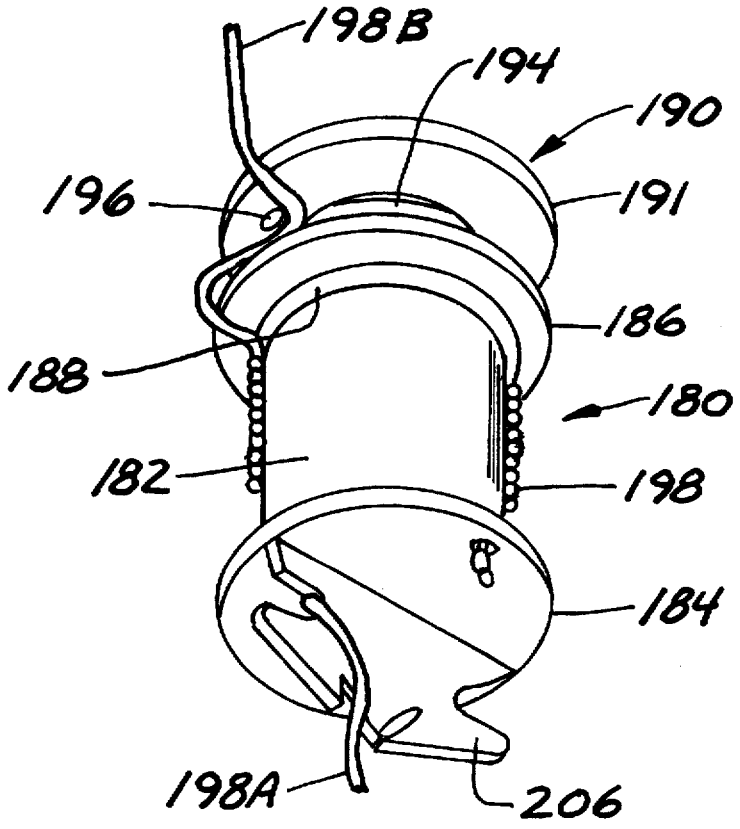
FIG. 11 is a perspective view of the hub assembly of FIG. 10 with parts in section and parts broken away.

A further modified form of the present invention is shown in FIGS. 10 and 11. In the exploded view of FIG. 10, a line tender device 170 is used with a line clutch substantially the same as that shown in the previous forms of the invention, but the device is especially adapted for use by a diver and a diver flag that would be visible from the surface. The flag is a floating flag that maintains a tension to the line as the diver descends.

The line tender device 170 includes a housing or base 178 that has a line reel section 180 having a central line reel surface 182 positioned between a first flange 184 and a second flange 186. A part conical or tapered surface 188 is provided between the cylindrical surface 182 and a position adjacent an outer edge of second flange 186. The housing or base 178 has an interior bore that can be sealed by putting on a cap 190 that fits over a cylindrical end portion 192. The cap 190 can be sealed in place to be supported adjacent the flange 186. The cap 190 has a wall that has a clutch hub surface 194, over which an O-ring 196 fits, as shown in the previous forms of the invention, once the cap 190 is in place over the cylindrical surface 192. The housing is hollow and is sealed at both ends when the cap is in place. Thus, the housing will float.

A line 198 is wrapped around the line reel surface 182 and also around the tapered surface 188. An end of the line opposite surface 186 passes through an opening in flange 184 and is tied off. A relatively short length of line 198A extends from a snubber 206. A hook 200 is provided at the free end of the line length 198A in this form of the invention, and it may be hooked onto a belt of a diver 202 that is represented in a block. The hook 200 can be attached to the diver 204 in any desired location. The length of line 198A is selected so the line tending device will float near but sufficiently spaced from the diver so the diver's fins or equipment will not interfere with the line tender. Excess length of line 198A can be wrapped around cleat 206.

The T-shaped line wrap cleat or snubber 206 is provided so that the diver can select the amount of extension of the line length 198A by wrapping it around the cleat or snubber 206. The line length 198A is thus selected to suit the diver.

The free end of line 198, shown as a length 198B, extends around the edge of the second flange 186 and under the O-ring 196, which holds it under a tension against the surface 194. The line passes around a flange 191 of the cap 190.

The line length 198B extends out from the housing 178 and has a flag hook 212 that can be attached to a loop or line attached to a float 214 for flag 199 in a suitable manner. The flag 199 is a diver's flag and will float upright when counterweighted.

The opposite end of the housing 178 also has a cleat or snubber 210 on cap 190, around which the line can be wrapped and fixed so that the extendible line section 198B, which normally will pay out from the reel 180 under tension, can be fixed and held for storage. Additional floats can be added to maintain the flag at the surface -to insure that when a diver is descending substantially directly below the housing 178, and is aligned with the central axis 216 of the housing, the line 198B will be payed out through the clutch hub, under the O-ring 196. As the angle of the line up to the flag increases relative to the central axis 216, that is, as the diver moves, the housing 178 will be moved with the diver and the line 198B will become snubbed on flange 191, as the O-ring 196 moves toward the flange 191. When the line length 198B is snubbed, any further paying out of the line is prevented under the loads applied to the line. The snubbing occurs when the angle of the line has increased a selected amount. The flag will then move to follow the diver as the diver moves laterally. The tension in the line 198B is from the flag formed by the float 214 and the weight of pull or force of the diver. The flange on the line clutch opposite the flange that serves as a snubber is for keeping the O-ring from coming off the hub. Other O-ring keepers can be used and a complete hub is not needed.

It should be noted that the separate line snubbers or cleats such as that shown on 210 or 206 can be provided to any one of the line tender that are shown in the embodiments herein, including the fixed float type embodiment.

The free end line length 198B can be attached to a diver with hook 212, and the housing and line reel left floating at or near the top of the water. The line length 198A could then be attached to the flag 199. The diver would be like the anchor weight in the previous forms of the invention.

The addition of the hooks at selected ends of the line 198 makes the line tender, having the line clutch, adapted to a wide variety of uses.

It is apparent that this type of a clutch can be adapted to any desired type of float merely by making a suitable coupling between the float and the line clutch, and it is not necessary that the inflating valve arrangement be utilized, if a previously inflated float is to be attached. The line tending unit therefore fulfills a need for a low cost type of clutch that will permit the line to unwind until a bottom of the body of water is reached, but will retain the line, thereafter, automatically against lateral movement caused by waves, wind or other facts.

This makes a very efficient, easily used marker device for people that need to mark locations in a body of water, or to mark other locations. The clutch also can act as a control to prevent a loading member from extending a line when the angle between the axis of the line clutch and reel and the loading member exceeds some selected amount. The strength of the O-ring, and the size of the flange on the clutch hub can be varied for changing the operating parameters.

Although the present invention has been described with reference to preferred embodiments, workers skilled in the art will recognize that changes may be made in form and detail without departing from the spirit and scope of the invention.

What is claimed is:

1. A line tending device including a base having a central axis, a clutch hub on the base, a source of a line length that will extend from the base in response to a tension load thereon, said clutch hub having a clutch hub outer surface and having at least a first flange extending outwardly from a clutch hub central axis, and an elastomeric member overlying the clutch hub outer surface, said line length passing from along the clutch hub between the clutch hub outer surface and the elastomeric member, the line length having an end which is under tension loading as it extends from the clutch hub and moves between the elastomeric member and the clutch hub outer surface, the elastomeric member urging the line length toward the clutch hub outer surface to tend to provide a clamping action on the line length around the first flange which increases as the angle of the line length relative to the central axis of the clutch hub increases.

2. The device of claim 1 including a float for supporting one end of the line length in a body of water, and a weight providing member applying a tension load on the line reacted by the float.

3. The device of claims 1, wherein the source of a line length comprises a line reel portion on the base, the line being wound around a line reel hub on a side of the first flange opposite the clutch hub, and extending around an outer edge of the first flange to pass under the elastomeric member.

4. The device of claim 1 and a retainer member spaced in a direction along the clutch hub central axis from the first flange to retain the elastomeric member on the clutch hub.

5. The device of claim 4, wherein the elastomeric member comprises an annular elastomeric ring surrounding the clutch hub outer surface.

6. The device of claim 3, wherein the reel hub outer surface has a portion tapering from a first transverse dimension outwardly to join the first flange near an outer edge of the first flange.

7. The device of claim 3, wherein the line Length has an opposite end extending from the reel hub in direction away from the clutch hub, and a connector at the opposite end for connection to a separate object.

8. The device of claim 1, wherein the base is floatable and a coupler extending from the base for attachment to a diver, the line length having a floating marker attached thereto for providing a tension load between a diver coupled to the body and the marker.

9. The device of claim 8, wherein the marker comprises a floating diver's flag.

10. The device of claim 3, wherein the body is tubular, a float member at a first end of the body for supporting the body with the line reel above the clutch hub, and a light coupled to a lower end of the body and positioned to project light through an internal passage of the tubular body toward the float member.

11. A line tending device including a housing having a clutch hub adjacent one end thereof, a line reel formed on the housing and having a line thereon that will unwind in response to a tension load on a free end of the line and extend from the housing, said clutch hub having a clutch hub outer surface and at least one flange, the line extending from the line reel around the one flange and along the clutch hub as the line unwinds from tension loading on the one end, and an elastomeric ring surrounding the clutch hub outer surface, said line passing from the line reel over an outer edge of the one flange and inwardly to the clutch hub between the clutch hub outer surface and the elastomeric ring, tension loading on the one end of the line causing the line to extend from the housing and move between the elastomeric ring and the clutch hub outer surface as the line unwinds from the reel hub around the edge of the one flange, when the line extends substantially aligned with an axis of the clutch hub outer surface, the elastomeric ring providing a tension to force the line toward the clutch hub outer surface and around the one flange, and as an angle of the line extending from the housing relative to the axis of the clutch hub outer housing increases, the elastomeric ring moving toward the first flange to snub the line around an outer edge of the first flange.

12. The device of claim 11, wherein the housing has a float attached thereto to support, the line reel above the clutch, hub, and a ballast for maintaining the axis of the clutch hub outer surface in a generally upright position with the first flange oriented substantially horizontally and the axis of the clutch hub outer surface oriented substantially vertically while the housing is floated relative to the surface of the body of water.

13. The device of claim 11, wherein the line reel has a tapered annular surface joining the first flange and tapering to a smaller size in direction away from the clutch hub.

14. The device of claim 12 including a coupling for attaching a light to the housing at a lower end thereof.

15. The device of claim 10 including a float coupled to one of the housing and the one end of the line, and a weight providing member coupled to the other of the housing and the one end of the line, wherein the float and weight providing member provide tension in the line as they tend to separate.

16. The device of claim 15, wherein the housing has a line cleat at one end of the housing for securing a line to prevent extension of the line.

* * * * *